US011255225B2

(12) United States Patent
Boz et al.

(10) Patent No.: US 11,255,225 B2
(45) Date of Patent: Feb. 22, 2022

(54) ROCKER ARM MECHANISM

(71) Applicant: FORD OTOMOTIV SANAYI A. S., Istanbul (TR)

(72) Inventors: Hakan Boz, Istanbul (TR); Mehmet Masat, Istanbul (TR); Goktan Kurnaz, Istanbul (TR)

(73) Assignee: FORD OTOMOTSV SANAYI A. S., Istanbul (TR)

( * ) Notice: Subject to any disclaimer, the term of this patent is extended or adjusted under 35 U.S.C. 154(b) by 0 days.

(21) Appl. No.: 16/772,210

(22) PCT Filed: Feb. 7, 2018

(86) PCT No.: PCT/TR2018/050045
§ 371 (c)(1),
(2) Date: Jun. 12, 2020

(87) PCT Pub. No.: WO2019/117825
PCT Pub. Date: Jun. 20, 2019

(65) Prior Publication Data

US 2021/0071548 A1 Mar. 11, 2021

(30) Foreign Application Priority Data

Dec. 14, 2017 (TR) ..... 2017/20332

(51) Int. Cl.
*F01L 1/18* (2006.01)
*F01L 1/047* (2006.01)
(Continued)

(52) U.S. Cl.
CPC ..... *F01L 1/181* (2013.01); *F01L 1/047* (2013.01); *F01L 13/0021* (2013.01);
(Continued)

(58) Field of Classification Search
CPC ..... F01L 1/181; F01L 13/0021; F01L 13/06; F01L 2820/042; F01L 13/065;
(Continued)

(56) References Cited

U.S. PATENT DOCUMENTS 4,593,662 A * 6/1986 Baring ..... F01L 1/26 123/198 F
4,793,307 A * 12/1988 Quenneville ..... F01L 13/065 123/323
(Continued)

FOREIGN PATENT DOCUMENTS

CN 102840005 A 12/2012
CN 105736086 A 7/2016
(Continued)

*Primary Examiner* — Patrick Hamo
*Assistant Examiner* — Wesley G Harris
(74) *Attorney, Agent, or Firm* — Bayramoglu Law Offices LLC

(57) ABSTRACT

A rocker arm mechanism capable of selectively adjusting a timing of opening or closing an intake or an exhaust valve of a plurality of exhaust valves by shifting according to a crankshaft angle and by gradually changing a maximum valve opening, or electively, allows for engine braking by decompression by opening the plurality of exhaust valves before a compression stroke in a plurality of internal combustion engines.

13 Claims, 6 Drawing Sheets

(51) Int. Cl.

| | |
|---|---|
| ***F01L 13/00*** | (2006.01) |
| ***F01L 13/06*** | (2006.01) |
| ***F02D 13/02*** | (2006.01) |
| ***F02D 13/04*** | (2006.01) |

(52) U.S. Cl.
CPC ..... *F01L 13/06* (2013.01); *F02D 13/0215* (2013.01); *F02D 13/04* (2013.01); *F01L 2820/042* (2013.01)

(58) Field of Classification Search
CPC ... F01L 13/0015; F01L 2305/00; F01L 1/267; F01L 13/0063; F01L 13/0026; F01L 1/18; F01L 1/26; F02D 13/0215; F02D 13/04
USPC ..... 123/90.16, 90.39, 90.44; 74/559
See application file for complete search history.

(56) References Cited

U.S. PATENT DOCUMENTS

| | | | | | |
|---|---|---|---|---|---|
| RE33,310 | E * | 8/1990 | Ajiki | F01L 1/267 | 123/90.16 |
| 5,107,803 | A * | 4/1992 | Furnivall | F01L 1/181 | 123/90.16 |
| 5,431,132 | A * | 7/1995 | Kreuter | F01L 1/2405 | 123/90.16 |
| 6,257,201 | B1 * | 7/2001 | Kajiura | F01L 13/06 | 123/321 |
| 7,121,241 | B1 * | 10/2006 | Genise | F01L 1/185 | 123/90.2 |
| 7,603,973 | B2 * | 10/2009 | Flierl | F01L 1/146 | 123/90.16 |
| 8,904,982 | B2 * | 12/2014 | Lowe | F01L 1/267 | 123/90.39 |
| 2010/0108007 | A1 * | 5/2010 | Meistrick | F01L 1/08 | 123/90.46 |
| 2015/0204250 | A1 | 7/2015 | Le Forestier | | |

FOREIGN PATENT DOCUMENTS

| | | | |
|---|---|---|---|
| EP | 0294682 | A1 | 12/1988 |
| EP | 2520773 | A2 | 11/2012 |
| EP | 3061926 | A1 | 8/2016 |
| GB | 2540736 | A | 2/2017 |
| WO | 2016207348 | A1 | 12/2016 |

* cited by examiner

ROCKER ARM MECHANISM

CROSS-REFERENCE TO THE RELATED APPLICATIONS

This application is the national stage entry of International Application No. PCT/TR2018/050045, filed on Feb. 7, 2018, which is based upon and claims priority to Turkish Patent Application No. 2017/20332, filed on Dec. 14, 2017, the entire contents of which are incorporated herein by reference.

TECHNICAL FIELD

The invention relates to a rocker arm mechanism which is capable of selectively adjusting the timing of opening or closing the intake or exhaust valve by shifting according to the crankshaft angle and by gradually changing the maximum valve opening, or which, again selectively, allows for engine braking by decompression by opening the exhaust valves before the compression stroke in internal combustion engines.

BACKGROUND

Internal combustion engines present one of the machines that convert chemical energy to mechanical energy with combustion. Internal combustion engines create a force as a result of combusting fossil fuels in the cylinder, which force enables them to perform a rotational movement. Internal combustion engines basically consist of an engine block, a cylinder head, a clutch shaft, a clutch lever, cylinders, pistons and a crankshaft. The preservation of the upper portion of the engine block is ensured by way of the cylinder head. The cylinder head is provided therein with igniters by which combustion takes place, intake valves for filling of the air-fuel mixture into the cylinder, and exhaust valves opened for transferring the exhaust gas formed after combustion to the outer environment.

Engine braking is a frequently used braking method particularly used in heavy commercial vehicles. Engine braking is the method in which braking of a vehicle is ensured without using a service brake. This method is based on the principle of using the rolling friction of the engine in order to reduce the vehicle speed. Even if the gas pedal is not stepped on while driving downhill and fuel is not delivered to the cylinders, the crankshaft of the engine will be forced to rotate due to the torque applied to wheels while gear is engaged. However, the crankshaft resists against rotation (due to the compression in cylinders and the resistance of the friction components). Due to such resistance, the wheels also roll slowly, causing the vehicle to slow down. Apart from this, downshifting causes the crankshaft to rotate faster despite the fact that vehicle speed remains unchanged. As the engine revolution increases, so does the rolling friction of the engine. Accordingly, low gear leads to higher engine braking force.

Particularly in heavy commercial vehicles, the continuous use of service brakes causes the maintenance frequency and operating costs to increase. Engine braking is used so as to avoid such increase in costs. Nevertheless, the engine brakes used in heavy commercial vehicles today are operated by hydraulic lock mechanism; and the engine braking performance can be adversely affected as a result of such parameters as oil temperature, engine speed, and cylinder pressure increasing hydraulic losses. In the systems capable of braking without the use of hydraulic lock mechanism, however, the risk of damage exists due to overloading of the components as they cannot provide sufficient force transmission area instantaneously during critical switches to/from engine brake opening/closing.

The Chinese Patent Application No. CN105736086 (A) in the state of the art discloses a combustion braking and pressure reduction braking combined engine braking method. In this design, the engine braking control module is not opened when the engine braking is not needed. The engine operates normally. Conventional ignition exhaust cam and a braking exhaust cam of an engine reduced pressure braking assembly are disposed on the first axial position of the spline camshaft. When the engine brake is operated, the engine throttle valve is partly opened and fuel injection takes place. The engine decompression brake control module is operated so that the conventional ignition exhaust cam and the braking exhaust cam of the engine reduced pressure braking assembly will be moved to the second axial position of the spline camshaft. The engine brake exhaust cam drive actuates the exhaust valve for engine decompression.

In the U.S. Patent Application No. US2015204250 (A1) in the state of the art, a valve actuation mechanism for an internal combustion engine on an automotive vehicle is disclosed. The invention also relates to a truck equipped with a valve actuation mechanism. The valve actuation mechanism in this design comprises a camshaft rotatable around a longitudinal axis. The camshaft comprises several cams, each being dedicated to moving the valves of one cylinder of an internal combustion engine. Each cam has a cam profile which may comprise one or several "bumps", i.e. valve lift sectors where the cam profile exhibits a bigger eccentricity with respect to axis than the base radius of the cam.

The British (United Kingdom) Patent Application No. GB2540736 (A) in the state of the art discloses a rocker arm assembly that opens only one exhaust valve during a braking event in drive (combustion) mode. In this design, the exhaust valve rocker arm assembly comprises an exhaust rocker arm that rotates about a rocker shaft. Exhaust valve rocker arm assembly further comprises a valve bridge, a valve assembly, and an engine brake actuator. The valve bridge engages a first and second exhaust valve associated with a cylinder of an engine. The exhaust rocker arm rotates around the rocker shaft based on a lift profile of a cam shaft. The exhaust valve rocker arm assembly can have an actuator assembly having an actuator lever, an actuator piston, an actuator spring and a registering bolt.

Besides, the Chinese Patent Application No. CN102840005 and European Patent Application EP0294682A1 in the state of the art discloses a rocker arm assembly.

The present invention, however, allows for selectively changing the exhaust valve timing in internal combustion engines, preferably four-stroke internal combustion engines. Thus, engine braking is made by decompression through opening the exhaust valves prior to compression stroke. In doing so, a mechanism based on mechanical distance compensation is utilized instead of hydraulic lock mechanism; hence, the problem of being affected by the oil condition is overcome. The problems regarding oil filling at high engine speeds is also eliminated thanks to the continuous activated state. With the present invention, the frictional differences between cylinders are reduced and with a more stable engine brake operation, reduced crankshaft torsional vibrations are formed. With a design safe against breakdown during critical switches (opening/closing), the overloading of the mechanism is prevented. The invention is not limited to the exhaust valves and engine brakes; rather, it can be adapted to other replaceable valve timing systems as well.

The object of the present invention is to provide a rocker arm mechanism which allows for selectively changing the exhaust valve timing in internal combustion engines.

And another object of the present invention is to provide a rocker arm mechanism which performs engine braking by decompression through opening the exhaust valves prior to compression stroke.

SUMMARY

The rocker arm mechanism which has been embodied for achieving the objects of the present invention and which is defined in the first claim as well as the other dependent claims is preferably provided with a rocker arm. One side of said rocker arm is in communication with the camshaft while the other side is engaged with the exhaust valve. A hole is made in an area close to the middle portion of the rocker arm so that the rocker shaft will be positioned therein. The rocker arm transfers the movement that it receives from the camshaft around said hole axis, to the exhaust valve. The side of the rocker arm in connection with the exhaust valve is provided with a movement member. Said movement member is capable of rotating clockwise or counterclockwise around its own axis by means of a rotating bracket. The movement member in this embodiment of the invention is able to perform such rotations via a first force applying means and a second force applying means.

BRIEF DESCRIPTION OF THE DRAWINGS

The rocker arm mechanism which has been developed for achieving the objects of the present invention is illustrated in the accompanying drawings, in which.

Figure 1:
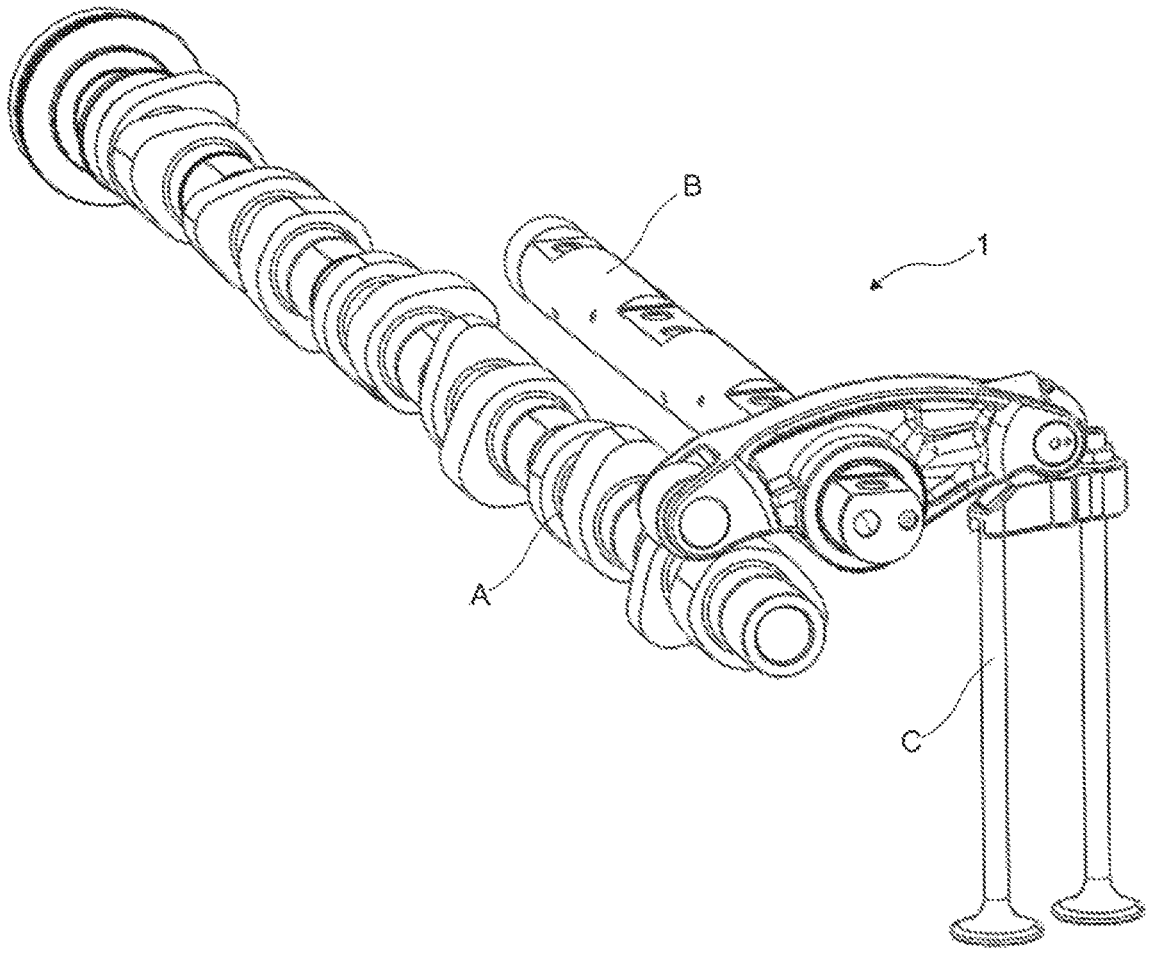
FIG. 1 Perspective view of the rocker arm mechanism along with the camshaft and rocker shaft.
Figure 2:
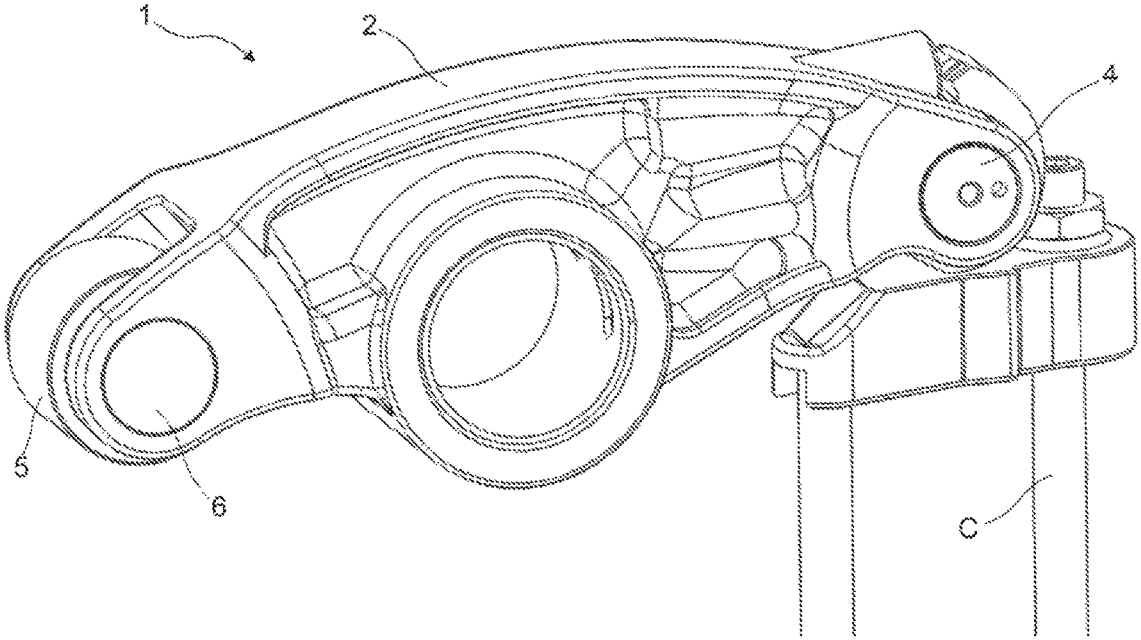
FIG. 2 Perspective view of the rocker arm mechanism from an angle.
Figure 3:
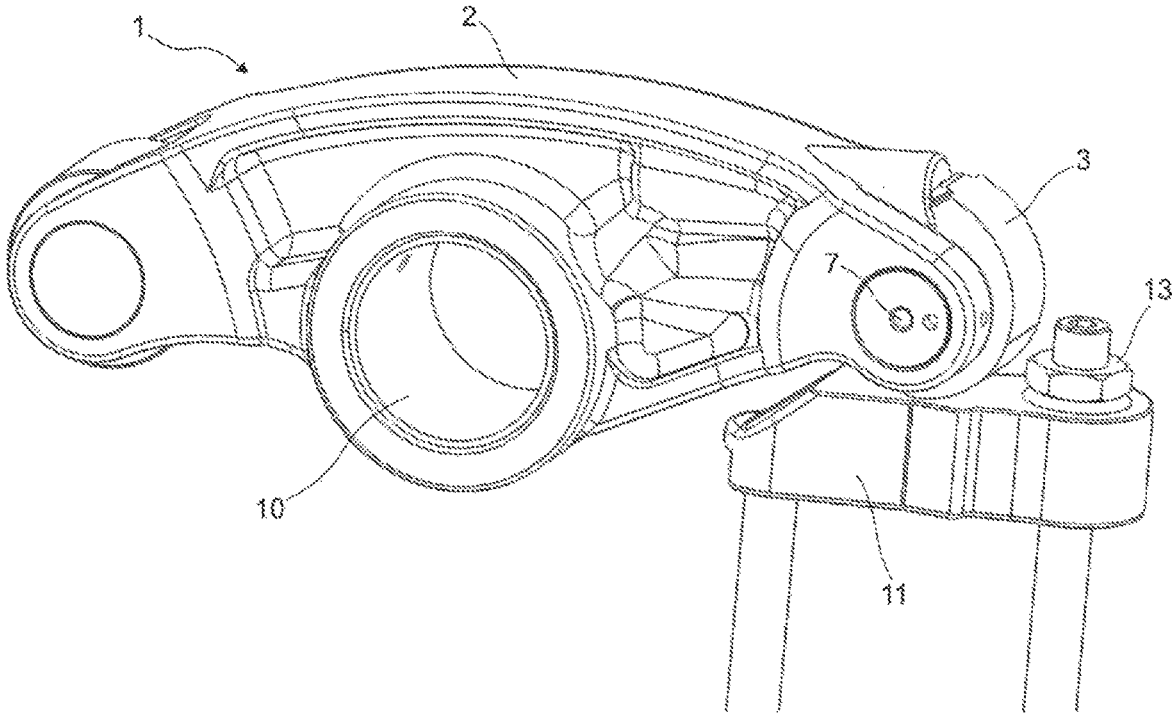
FIG. 3 Perspective view of the rocker arm mechanism from another angle.
Figure 4:
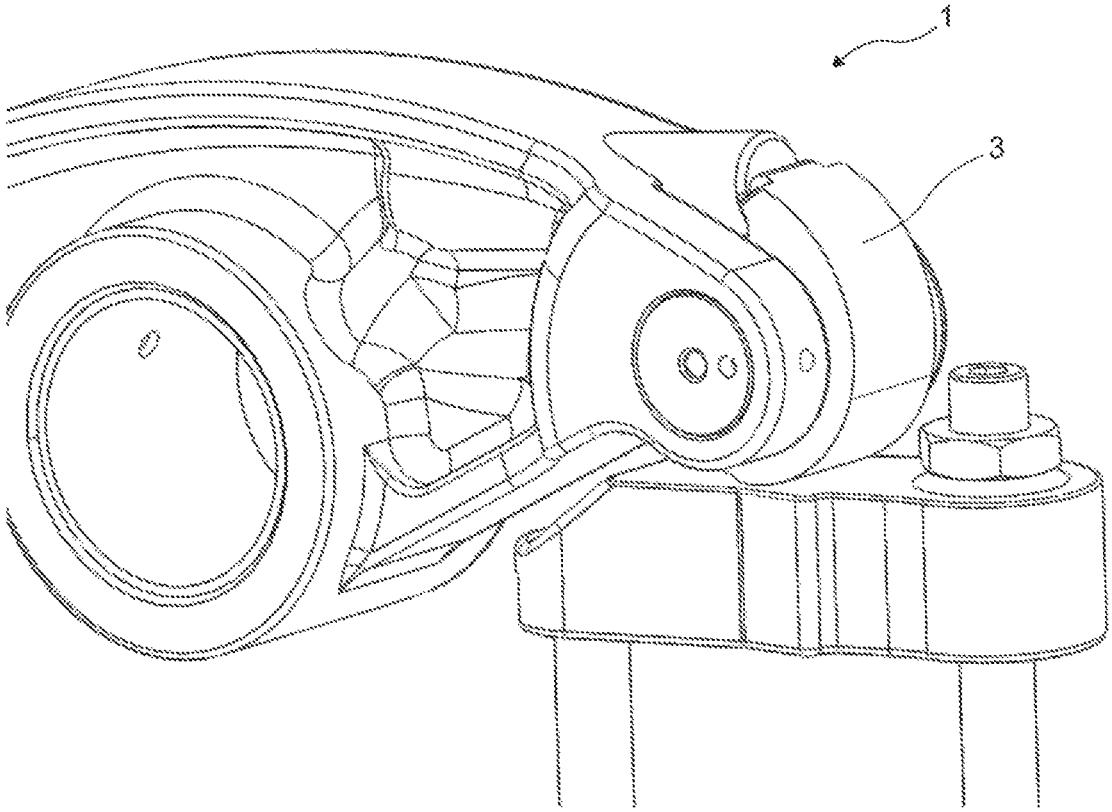
FIG. 4 Perspective view of the rocker arm mechanism from another angle.
Figure 5:
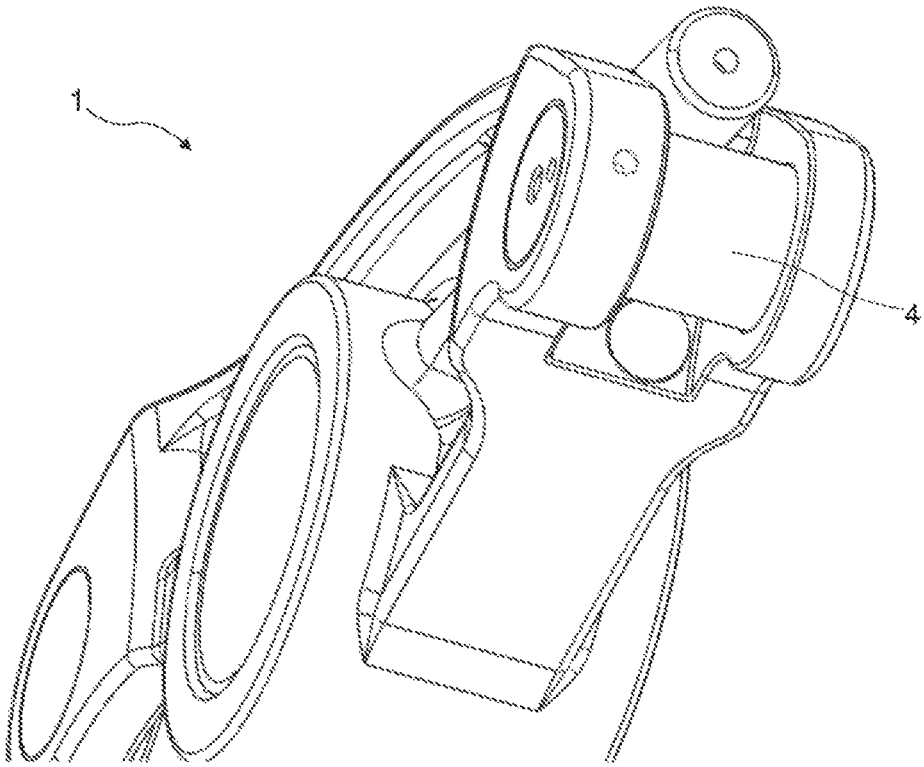
FIG. 5 Perspective view of the rocker arm mechanism from another angle.
Figure 6:
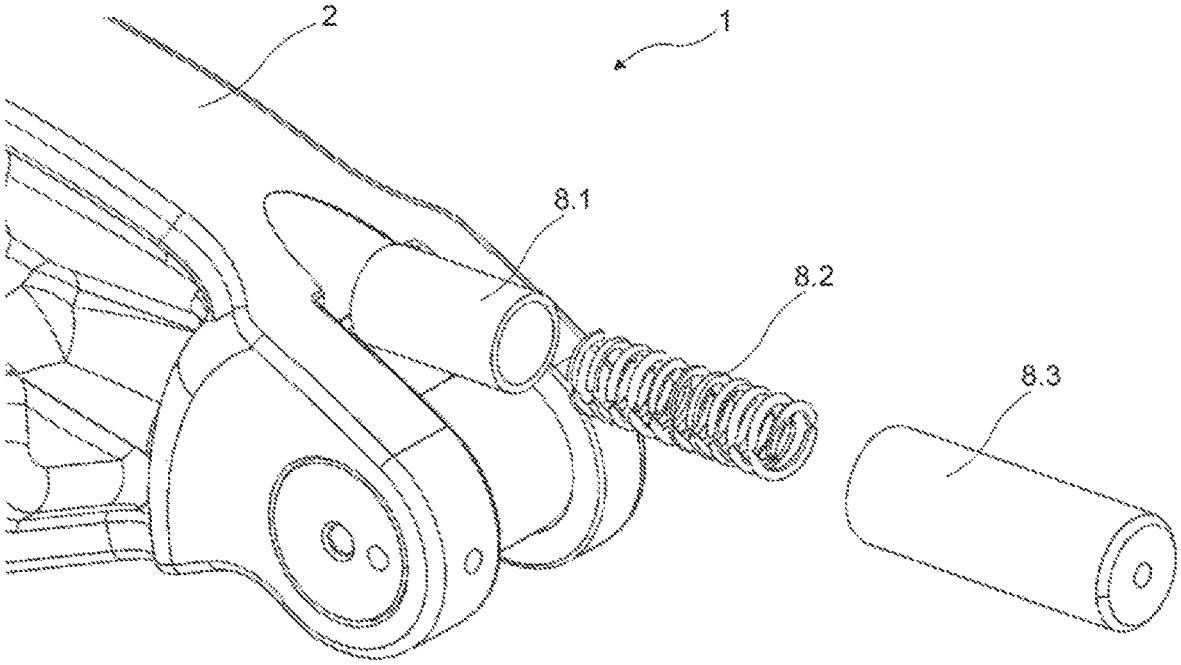
FIG. 6 Perspective view of the rocker arm mechanism along with the exploded view of the first force applying means.
Figure 7:
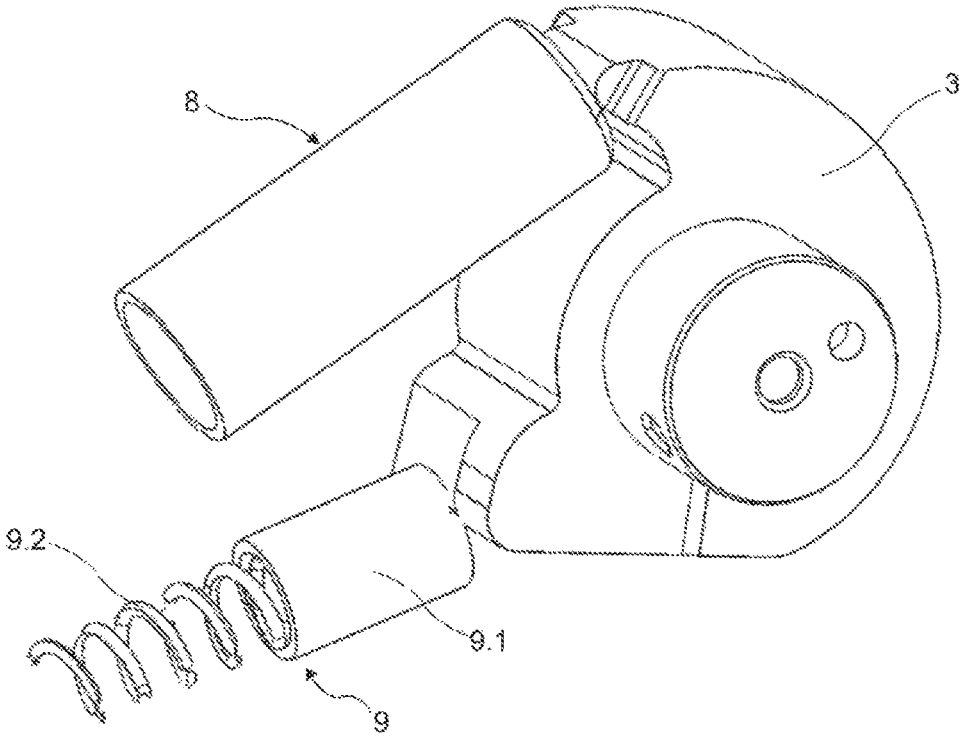
FIG. 7 Perspective view of the movement member, the first force applying means, and the second force applying means.

The parts in the drawings are enumerated individually and the reference numbers corresponding thereto are presented below.

1. Rocker arm mechanism
2. Rocker arm
3. Movement member
3.1. First extension
3.2. Second extension
3.3. Bend
3.4. Plane
4. Rotating bracket
5. Main rotator
6. Main rotator support
7. Oil plug
8. First force applying means
8.1. Force piston
8.2. First resilient element
8.3. Brake piston
9. Second force applying means
9.1. Positioning piston
9.2. Second resilient element
10. Bushing
11. Bridge
12. Adjusting pin
13. Fastening element
A. Camshaft
B. Rocker shaft
C. Exhaust valve

DETAILED DESCRIPTION OF THE EMBODIMENTS

The rocker arm mechanism (1) which is capable of selectively adjusting the timing of opening or closing the intake or exhaust valve (C) by shifting according to the crankshaft angle and by gradually changing the maximum valve opening, or which, again selectively, allows for engine braking by decompression by opening the exhaust valves (C) before the compression stroke in internal combustion engines, basically comprises:

at least one rocker arm (2) which is engaged with the camshaft (A) from one side and with the exhaust valve (C) from the other side thereof and which transfers the movement formed by means of the camshaft (A) to the exhaust valve (C), and at least one movement member (3) which is connected to the side of the rocker arm (2) engaged with the exhaust valve (C) and capable of rotating clockwise or counterclockwise around an axis; and which permits optionally changing the opening and closing time and interval of the valves by applying a force to the exhaust valve (C) as a consequence of such rotation in the direction of the axis in which the exhaust valve (C) moves, changing the position of the exhaust valve (C) in said axis independent of the movement received from the camshaft (A) and relatively.

The rocker arm mechanism (1) in an embodiment of the invention is preferably provided with a rocker arm (2). Said rocker arm (2) is engaged with the camshaft (A) from one side and with the exhaust valve (C) from the other side thereof. The side of the rocker arm (2) in connection with the exhaust valve (C) is provided with a movement member (3). Said movement member (3) is rotatable clockwise or counterclockwise and/or slidable in axial direction by means of a rotating bracket (4) passing through its middle portion. Both sides of the rotating bracket (4) are connected to the side of the rocker arm (2) in engagement with the exhaust valve (C). In the middle portion of the rotating bracket (4), there exists a movement member (3). The movement member (3) is in engagement with the rotating bracket (4) and capable of rotating about the rotating bracket (4) freely. In order for the rocker arm (2) to be driven by the cams disposed in the camshaft (A) in a time-dependent manner, there exist a main rotator (5) at the side of the rocker arm (2) in engagement with the camshaft (A). Said main rotator (5), in turn, is in connection with the rocker arm (2) by a main rotator support (6). Similar to the movement member (3), the main rotator (5) is also capable of rotating freely about the main rotator support (6) in both directions. The contact surface permanently changes thanks to the engagement of the main rotator (5) with the camshaft (A), and to the fact that the main rotator (5) rotates around its own axis every time it contacts with the camshaft (A).

The movement member (3) provided in this embodiment of the invention is moved clockwise or counterclockwise by way of a first force applying means (8) and a second force applying means (9). The axis which passes through the center of the movement member (3) and is perpendicular to the movement direction of the exhaust valve (C) is provided with the first force applying means (8) at one side and with the second force applying means (9) at the other side thereof. The movement member (3) is in direct engagement with said first force applying means (8) and second force applying means (9). The first force applying means (8) in this embodiment of the invention is configured such that it will be activated when preferred and rotate the movement member (3) in a direction by applying a force on the movement member (3). In this embodiment of the invention, the second force applying means (9) is passive, i.e. it applies a force on the movement member (3) only at a determined strength in reverse direction to the direction in which the first force applying means (8) rotates the movement member (3). In other words, in case the movement member (3) is rotated in a direction by means of the first force applying means (8), then the second force applying means (9) applies a rotational force on the movement member (3) in the other direction, thereby trying to make the movement member (3) assume its original position.

The rocker arm mechanism (1) in this embodiment of the invention can be described in further detail as below. Provided in the middle portion of the rocker arm (2) is a hole through which the rocker shaft (B) can pass. The rocker shaft (B) is passed through said hole; thus, the movement received by the rocker arm (2) from the camshaft (A) is transmitted to the exhaust valve (C). The rocker arm (2) has a bushing (10) in the hole, into which the rocker shaft (B) is introduced. Said bushing (10) is arranged between the rocker shaft (B) fixed in the cylinder head and the hole mentioned above. As mentioned above, there exists a main rotator (5) which rotates about the main rotator support (6) in order to avoid wearing out likely to result from the high force formed during the transmission of the cam profile disposed in the camshaft (A). The rocker arm (2) is provided with a movement member (3) which is rotatable about a rotating bracket (4) at the side of the bridge (11) enabling both the exhaust valves (C) thereof to be opened simultaneously; and which also comprises, in a way to pass through its center, a first extension (3.1) as well as a second extension (3.2) which is in contact with the bridge (11) when the engine brake is not activated, said extensions being arranged at two sides thereof serving as a contact interface so that it will perform pushing, pulling, or rotating movements with the first force applying means (8) and the second force applying means (9). The movements of the movement member (3), on the other hand, are performed by the first force applying means (8) and the second force applying means (9) as mentioned above. The first force applying means (8) preferably consists of a force piston (8.1), a first resilient element (8.2), and a brake piston (8.3). The second force applying means (9), on the other hand, preferably consists of a positioning piston (9.1) and a second resilient element (9.2). In the rocker arm (2), there exists a second force applying means (9) which has a positioning piston (9.1) which is in contact with the movement member (3) in a way to control the position of the movement member (3) and a second resilient element (9.2) preloading this positioning piston (9.1). The rocker arm (2) is further provided therein with a first force applying means (8) which has a brake piston (8.3), a force piston (8.1) capable of moving axially inside the brake piston (8.3), and a first resilient element (8.2) capable of preloading between the force piston (8.1) and the brake piston (8.3).

In the rocker arm mechanism (1) provided in this embodiment of the invention, the rocker arm (2) preferably has channels with various diameters and sizes which allow the fluid to reach the components that are hydraulically controlled and to oil the components that are in contact therewith, and oil plugs (7) which serve for creating pressure by closing the areas through which said channels open to the atmosphere.

In the rocker arm mechanism (1) in this embodiment of the invention, in order to ensure that the distance between the bridge (11) and movement member (3) is adjustable, there exist an adjusting pin (12) which is attached on one of the exhaust valves (C) in a spaced manner and enables the vertical position of the bridge (11) to be adjusted by being engaged in the thread provided in the area coinciding with the exhaust valve (C), and a fastening element (13) enabling said adjusting pin (12) to be secured at the end of adjustment.

In the normal operating mode of the engine provided in this embodiment of the invention, the exhaust valves (C) are required to be opened only during the exhaust stroke. The transmission of the peaks, which are required for the operation of the engine brake disposed on the camshaft (A), to the exhaust valves (C) as movement during normal operating conditions must be prevented. In order to achieve this, a space at least as high as said peaks must be provided between the bridge (11) and movement member (3). The movement member (3) is provided with a first extension (3.1) and a second extension (3.2) at two separate sides of the axis which passes through the center of the movement member (3) and is perpendicular to the movement direction of the exhaust valve (C). The first extension (3.1) is in direct engagement with the first force applying means (8) while the second extension (3.2) is in direct engagement with the second force applying means (9). There is a difference between the radial distances of the bend (3.3), provided on the movement member (3), and the plane (3.4) with respect to the axis of the rotating bracket (4) around which the movement member (3) is capable of moving clockwise and counterclockwise, said distance being at least as much as the size of the valve opening to which the peak, which is disposed on the camshaft (A) and required for the operation of the engine brake, corresponds. In other words, the movement member (3) has a bend (3.3) and plane (3.4) between the radial distances, with respect to the center of main rotator support (6), which enables the space between the camshaft (A) and main rotator (5) to be selectively adjusted and around which the main rotator (5) is capable of rotating clockwise and counterclockwise, of which there exists a difference at least as much as the size of the exhaust valve opening defined during engine braking. When the engine brake is not activated, i.e. during the normal operating mode, the second extension (3.2) is in contact with the bridge (11). The movement member (3) is also in contact with a positioning piston (9.1) preloaded by the second resilient element (9.2). Upon the force applied by this positioning piston (9.1), the second extension (3.2) disposed in the movement member (3) becomes in linear contact with the bridge (11).

When the camshaft (A) moves the rocker arm (2) towards the bridge (11) by way of the main rotator (5), the second resilient element (9.2) is compressed and the distance between the movement member (3) plane (3.4) and bridge (11). By this means, the bridge (11) can be maintained stably without being moved.

Figure 8:
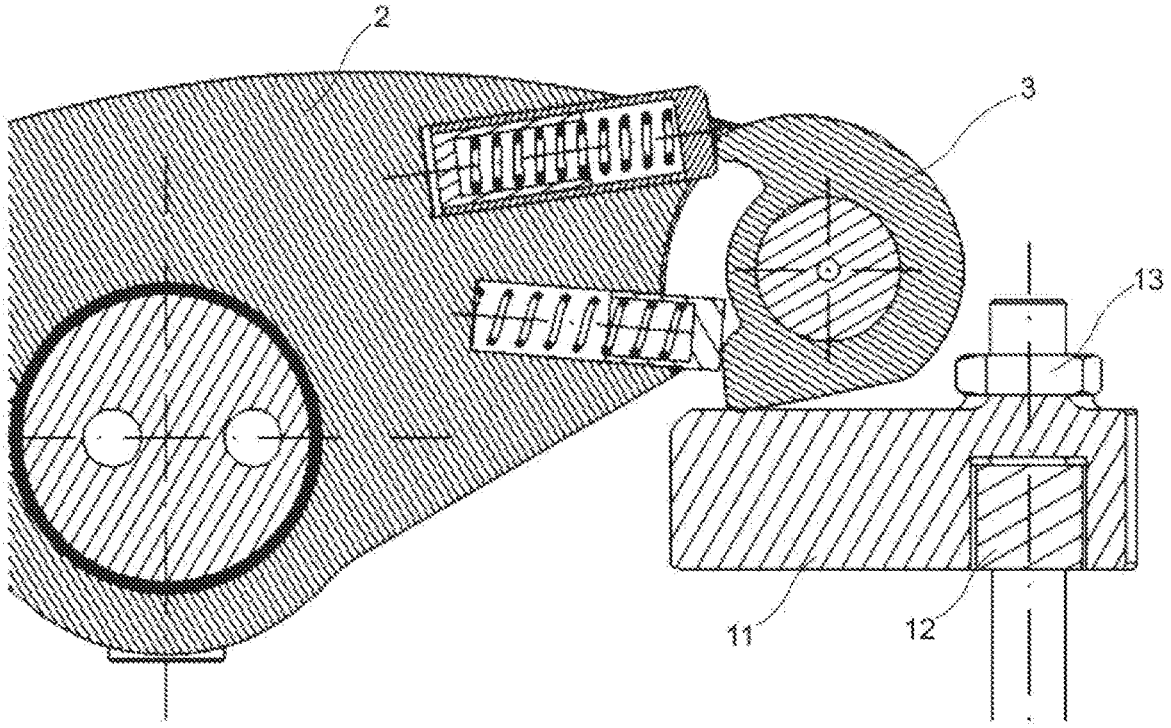
FIG. 8 Cross-sectional view of the movement member within the rocker arm mechanism when the engine brake is closed.
Figure 9:
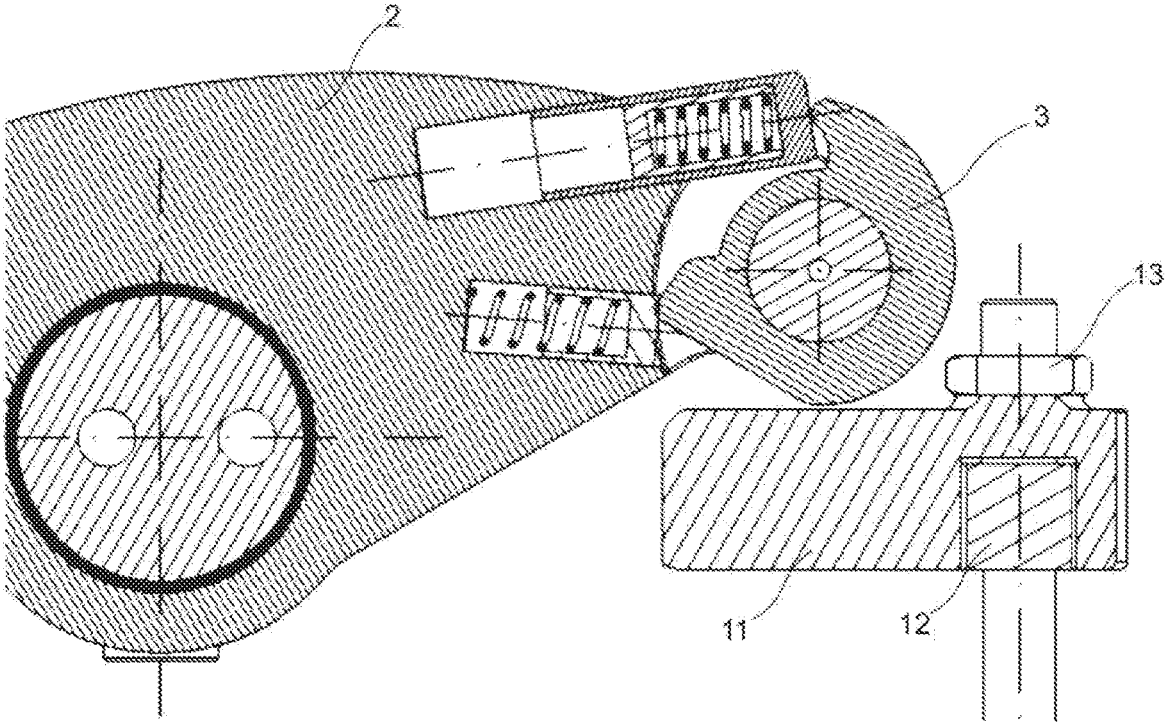
FIG. 9 Cross-sectional view of the movement member within the rocker arm mechanism when the engine brake is opened.

In the engine provided in this embodiment of the invention, the movement member (3) is required to be taken from the position in FIG. 8 to the position in FIG. 9 in case the engine brake is preferred to be activated. In order to perform this operation, the movement member (3) is moved by the force piston (8.1) with a larger force than that of the second resilient element (9.2). The fluid selectively delivered, preferably from a solenoid-controlled valve mechanism reaches the force piston (8.1) pool in order to allow said movement. Here, the force piston (8.1) is designed taking its diameter and the minimum engine brake activation pressure of the second resilient element (9.2) into account. The distance between the bridge (11) and the movement member (3) disposed at the exhaust valve (C) side of the rocker arm (2) moved by the exhaust valve (C) timing profile changes during normal operating conditions, except for the exhaust stroke. Said changing distance is at a degree that will enable the movement member (3) to rotate at a limited time of the whole valve movement (during a given crank angle). During other times, this distance becomes quite smaller and nullified during the exhaust stroke. Therefore, the force piston (8.1) pool is completely filled with fluid for a full activation. There remains limited time for this filling operation depending on the engine speed. Since it is not possible move the movement member (3) physically during the exhaust stroke, the fluid delivered in the meantime is used for preloading the first resilient element (8.2). The first resilient element (8.2) preloaded in the exhaust stroke applies a force on the movement member (3) after the exhaust valves (C) are closed and makes the movement member (3) assume the position in FIG. 9 for a brief time, thereby enabling the engine brake to be opened.

Subsequent to the activation of the engine brake in this embodiment of the invention, there is a linear contact between the second extension (3.2) of the movement member (3) and the bridge (11). This contact can be transformed into a surface contact by adding a cavity on the surface of the bridge (11) with the same radius. Similarly, the contact surface can be optimized by providing the first extension (3.1) and the second extension (3.2) disposed on the movement member (3) with various geometries provided that the difference in their distances to the center of the movement member (3) will be preserved. When the engine brake is activated, the distance between the bridge (11) and the movement member (3) is shorter than that in the normal operating condition of the engine. The first extension (3.1) of the movement member (3) is selected with fixed radius with respect to the center of the rotating bracket (4), and thus preventing the formation of torque upon the engine braking forces acting on the movement member (3) and it is prevented from assuming the normal operating position, i.e. the position of the movement member (3) illustrated in FIG. 8. The radius can be increased at a certain degree at the continuation of the first extension (3.1) with fixed radius on the movement member (3). Thus, the movement member (3), during the engine braking operation, rotates a little more towards the position shown in FIG. 9, and making up this distance.

Figure 10:
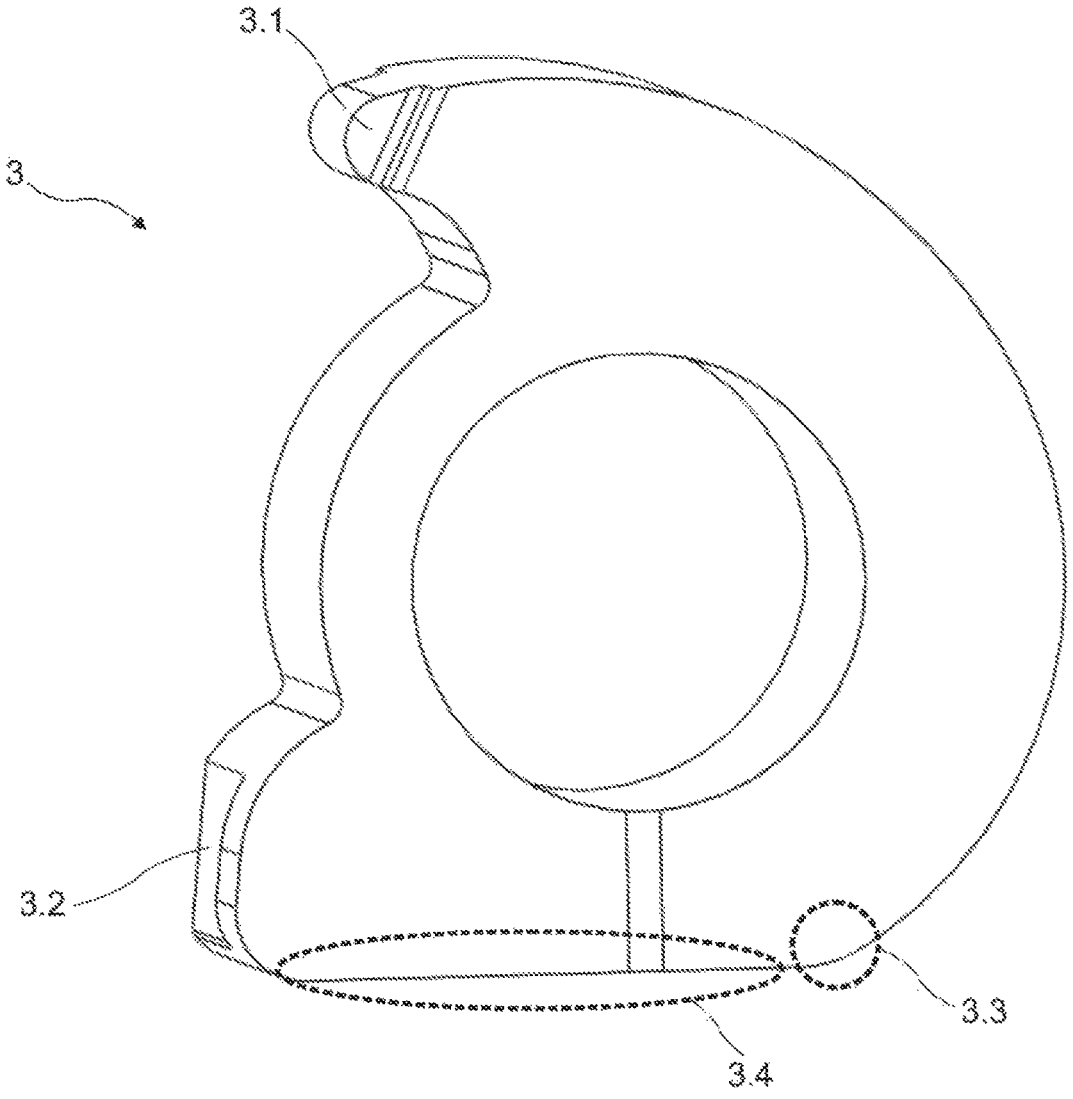
FIG. 10 Perspective view of the movement member.

In this embodiment of the invention, as the main rotator (5) will follow the cam on the camshaft (A) a little closer at a predetermined degree when the engine brake is engaged, normal closing time of the exhaust valves (C) is delayed and the maximum exhaust valve (C) opening is increased. Since the piston gets closer to the top dead center at the end of the exhaust stroke, it is important that the safe distance between the piston and the exhaust valve (C) is maintained by way of a pocket in the pistons, or by closing the engine brake henceforth. In order to pass from the fixed-radius bend (3.3) shown in FIG. 10 to the plane (3.4), the normal operating portion, so as to be able to close the engine brake in every exhaust cycle by making use of the relative angle formed by the rocker arm (2) with a horizontal direction every time the exhaust valve (C) gets close to maximum valve opening, the movement member (3) leans against a reference point in the rocker arm (2) near an angle that is close to the maximum relative angle formed by the movement member (3) with the rocker arm (2) when the engine brake is activated, the movement member (3) being in between the first extension (3.1) and the plane (3.4) in the meantime. In other words, maximum angle of the movement member (3) in the position shown in FIG. 9 is defined depending on the form. Thanks to remaining at the fixed radius in terms of relative shifting angle formed between the rocker arm (2) and the movement member (3) when the exhaust valves (C) reach the engine brake opening, the exhaust valves (C) are kept open while the piston gets close to the top dead center; however, the movement member (3) returning its position shown in FIG. 8 subsequent to additional shifting to occur in an area close to the exhaust valve (C) opening enables the exhaust valves (C) to be closed as in normal operating mode of the engine. After the exhaust valves (C) are closed, the engine brake is activated again, repeating this operation in every cycle. When the engine brake is engaged, the positioning piston (9.1) and the rocker arm (2) are in contact with the movement member (3). In the meantime, the torque created by the force formed on the movement member (3) by the second resilient element (9.2) is less than that created by the brake piston (8.3).

While the bend (3.3) disposed in this embodiment of the invention is in contact with the bridge (11) and plane (3.4) at a safe angular distance when the engine brake is opened, the movement member (3) is at the same time in contact with the positioning piston (9.1). At this moment, the torque created on the movement member (3) by the brake piston (8.3) is bigger, in every operation angle, than the torque in reverse direction created by the second resilient element (9.2) and tends to cause the movement member (3) to rest against the rocker arm (2). The second resilient element (9.2) which is incorporated behind the positioning piston (9.1) and which is capable of applying a force which is relatively big with respect to the force formed by the brake piston (8.3) when the engine brake is not activated, and relatively small when the latter is activated, keeps the movement member (3) away from the bridge (11) at a predetermined distance such that it will allow the bend (3.3) disposed in the movement member (3) to contact with the bridge (11) in the right position. Hence, the relative angle that will be formed even in maximum exhaust valve (C) opening when the engine brake is activated will compress the second resilient element (9.2) and the movement member (3) will rotate around its own axis instead of sliding on the bridge (11). When the engine brake is engaged, the positioning piston (9.1) and the movement member (3) are in contact with one another. In the meantime, the torque created by the force formed on the movement member (3) by the second resilient element (9.2) is less than that created by the brake piston (8.3) whereas the torque resulting from the forces formed by the second resilient element (9.2) on the positioning piston (9.1) is equal to the torque created by the force formed by the brake piston (8.3).

In this embodiment of the invention, in the activation of the engine brake, the oil feeding the brake piston (8.3) pool is interrupted by means of the solenoid when the engine brake is closed by the driver or control unit, and the volume remaining behind the brake piston (8.3) opens to the atmosphere. As of this moment, the force created by the second resilient element (9.2) makes the movement member (3) assume the position shown in FIG. 8, i.e. the normal operating position. As a result, normal exhaust valve (C) activation is performed.

What is claimed is:

1. A rocker arm mechanism, wherein the rocker arm mechanism is capable of selectively adjusting a timing of opening or closing an intake or an exhaust valve by shifting according to a crankshaft angle and by changing a maximum valve opening, or selectively, allows for engine braking by decompression by opening exhaust valves before a compression stroke in an internal combustion engine, and the rocker arm mechanism comprises:

at least one rocker arm, wherein the at least one rocker arm is engaged with a camshaft from one side of the at least one rocker arm and with the exhaust valve from another side of the at least one rocker arm and the at least one rocker arm transfers a movement formed by means of the camshaft to the exhaust valve of exhaust valves, and comprising: at least one movement member, wherein the at least one movement member is connected to a side of the at least one rocker arm engaged with the exhaust valve and capable of rotating clockwise or counterclockwise around an axis;

a clockwise and counterclockwise movement of the at least one movement member is ensured by a way of a first force applying means and a second force applying means via a rotating bracket, wherein the rotating bracket is within the at least one movement member, the at least one movement member is configured to apply a force, as a consequence of a clockwise or counterclockwise rotation, in a direction the exhaust valves move; and the at least one movement member permits optionally changing an opening and closing time and an interval of the exhaust valves by changing a position of the exhaust valve in a direction relatively and independent of the movement formed by means of the camshaft;

wherein the first force applying means is activated and is capable of rotating the at least one movement member in a direction by applying a force on the at least one movement member;

the first force applying means comprises, within the at least one rocker arm, a brake piston, a force piston capable of moving axially inside the brake piston, and a first resilient element capable of preloading between the force piston and the brake piston.

2. The rocker arm mechanism according to claim 1, wherein the at least one movement member, which has a rotation axis perpendicular to a movement direction of the intake or exhaust valve and the rotation axis passes through a centerline of the rotating bracket, comprising the first force applying means acting on opposite side of the at least one movement member and the second force applying means on another side.

3. The rocker arm mechanism according to claim 1, wherein the second force applying means applies a force on the at least one movement member only at a determined strength in a reverse direction to a direction, wherein in the direction the first force applying means rotates the at least one movement member; and the second force applying means comprises a positioning piston and a second resilient element, wherein the positioning piston is in contact with the at least one movement member to control a position of the at least one movement member and the second resilient element preloading the positioning piston.

4. The rocker arm mechanism according to claim 1, wherein the at least one movement member is rotatable about the rotating bracket at a side of a bridge enabling both the intake or exhaust valves (C) of the at least one rocker arm to be opened simultaneously; and the at least one movement member further comprises, a way to pass through a center of the at least one movement member, a first extension and second extension, wherein the second extension is in contact with the bridge when an engine brake is not activated, the first extension and the second extension serving as a contact interface so that the at least one movement member performs pushing, pulling, or rotating movements with the first force applying means and the second force applying means.

5. The rocker arm mechanism according to claim 1, wherein a bridge is adjustable in order to ensure a distance between the bridge and the at least one movement member, the bridge has an adjusting pin, wherein the adjusting pin is attached on one exhaust valve of the plurality of exhaust valves in a spaced manner and enables a vertical position of the bridge to be adjusted by being engaged in a thread provided in an area coinciding with the one exhaust valve, and a fastening element enabling the adjusting pin to be secured at an end of adjustment.

6. The rocker arm mechanism according to claim 1, wherein the at least one movement member has a bend and a plane between radial distances, with respect to a center of a main rotator support, wherein the main rotator support enables a space between the camshaft and a main rotator to be selectively adjusted and around the main rotator support, the main rotator is capable of rotating clockwise and counterclockwise, between the plurality of radial distances a difference at least as much as a size of an exhaust valve opening defined during the engine braking exists.

7. The rocker arm mechanism according to claim 1, wherein the second force applying means comprises a positioning piston and a second resilient element, the at least one movement member is in contact with the positioning piston preloaded by the second resilient element, and a second extension of the at least one movement member becomes in linear contact with a bridge upon a force applied by the positioning piston.

8. The rocker arm mechanism according to claim 1, wherein the second force applying means comprises a positioning piston and a second resilient element;

the at least one movement member is moved by the force piston, and the force piston is controlled by a fluid selectively delivered by a solenoid-controlled valve mechanism when an engine brake is activated in a combustion engine, with a larger force than the second resilient element.

9. The rocker arm mechanism according to claim 1, wherein the at least one movement member leans against a reference point in the at least one rocker arm near an angle, wherein the angle is close to a maximum relative angle formed by the at least one movement member with the at least one rocker arm in order to pass from a fixed-radius bend to a plane, a normal operating portion to be able to close an engine brake in every exhaust cycle by making use of a relative angle formed by the at least one rocker arm with a horizontal direction every time the exhaust valve of the exhaust valves becomes close to the maximum valve opening when the engine brake is activated.

10. The rocker arm mechanism according to claim 1, wherein the second force applying means comprises a positioning piston and a second resilient element; and the at least one movement member is in contact with the positioning piston and the at least one rocker arm when an engine brake is activated, wherein a torque created by a force formed on the at least one movement member by the second resilient element is less than a torque created by the brake piston.

11. The rocker arm mechanism according to claim 1, wherein the second force applying means comprises a second resilient element;

the at least one movement member has a bend, wherein the bend is in contact with a bridge when an engine brake is activated; and a torque created on the at least one movement member by the brake piston is bigger than the torque in a reverse direction created by the second resilient element, such that a main rotator follows a cam on the camshaft closer at a predetermined degree to enable a delayed closing time of the exhaust valves and an increased maximum exhaust valve opening.

12. The rocker arm mechanism according to claim 1, wherein the second force applying means comprises a second resilient element and a positioning piston, wherein the second resilient element is incorporated behind the positioning piston and the second resilient element is capable of applying a force bigger than a force formed by the brake piston when an engine brake is not activated, and smaller than the force formed by the brake piston when the engine brake is activated; and the engine brake keeps the at least one movement member away from a bridge at a predetermined distance such that a bend disposed in the at least one movement member is in contact with the bridge in a right position, wherein the right position is such that when the engine brake is activated and the second resilient element is compressed, the at least one movement member rotates around the axis instead of sliding on the bridge.

13. The rocker arm mechanism according to claim 1, wherein the second force applying means comprises a second resilient element, and the at least one movement member, in a deactivation of an engine brake, returns to a normal operating position of the at least one movement member by a force formed by the second resilient element subsequent to interrupting an oil feeding the brake piston by means of a solenoid and opening a volume remaining behind the brake piston to atmosphere.

* * * * *